United States Patent [19]

Koester

[11] Patent Number: 4,967,525

[45] Date of Patent: Nov. 6, 1990

[54] DOOR ASSEMBLY

[75] Inventor: Frank Koester, Forest Hills, N.Y.

[73] Assignee: A Collaboration of Three Designers, New York, N.Y.

[21] Appl. No.: 270,818

[22] Filed: Nov. 14, 1988

Related U.S. Application Data

[63] Continuation-in-part of Ser. No. 54,801, May 27, 1987, Pat. No. 4,813,192.

[51] Int. Cl.[5] ..... E04B 1/74

[52] U.S. Cl. ..... 52/404

[58] Field of Search ..... 52/207, 204, 210, 311, 52/457, 455; 232/22, 45, 46, 19

[56] References Cited

U.S. PATENT DOCUMENTS

| | | | |
|---|---|---|---|
| 2,849,175 | 8/1958 | Thieman | 232/45 X |
| 3,197,931 | 8/1965 | Seery | 52/210 X |
| 3,568,383 | 3/1971 | Judkins et al. | 52/210 |
| 3,628,297 | 12/1971 | Richardson | 52/311 X |
| 3,643,395 | 2/1972 | Schuyler et al. | 52/311 X |
| 3,811,238 | 5/1974 | Brinker | 52/204 |
| 4,502,249 | 3/1985 | Banford | 52/207 X |
| 4,577,444 | 3/1986 | Sanderson | 52/311 |

*Primary Examiner*—Carl D. Friedman
*Attorney, Agent, or Firm*—Abraham Ogman

[57] ABSTRACT

The invention is directed to a door assembly comprising a door and a side panel assembly having a front and a rear wall. The front wall is formed by one or more releasably secured panels which may be accessed from the front or from the rear through a panel in the rear wall.

A mail slot is also described and claimed.

9 Claims, 4 Drawing Sheets

DOOR ASSEMBLY

This application is a Continuation in Part of the application Ser. No. 07/054,801 Filed May 27, 1987 entitled A Door Assembly now U.S. Pat. No. 4,813,192.

DEFINITIONS

For the purpose of this discussion the term "releasably secured" or "removable" when applied to a part or component of a door assembly shall mean that the part or component can be removed and replaced or substituted without dismantling parts of the door assembly.

BACKGROUND OF THE INVENTION

This invention is directed to a door assembly and more particularly to a door assembly which includes means for mounting accessories such as a mail slot graphics panels and the like. The structure of the door assembly lends itself to harmony in design.

Conventional single doors are generally supported, vertically, between two door jambs. While there is room for electrical wiring within the jamb and a mail slot in the door it is not practical to mount electronic surveillance equipment on or in the door.

The need to meet fire codes makes it impractical to provide removable graphics panels on the door. A "Fire Assembly" is only warrented for the life of the original installation. Also the NFPA 80 code for Fire Doors and Windows (1981) requires that preparation for locks, latches, hinges, glass panels etc. be covered by the manufactures inspection service procedure and under "Underwriter Laboratory (UL) Label Service".

As tenants come and go there is often a need to change numbers on the doors as well as the names of the tenants. Conventional door assemblies often require the replacement of a door to accomplish these changes. U.S. Pat. Nos. 2,849,175, 3,197,931, 3,568,383, 3,811,238 and 4,502,249 were cited in the parent case.

Only the patent to Thieman remains relevant. Thieman shows a tubular sleeve adapted to fit through the thickness of a wall. The tubular sleeve contains a rectangular frame which is configured to encircle the tubular sleeve. There are no lateral extensions on the frame.

OBJECTS

It is an object of the invention to provide a door assembly which avoids the limitations and disadvantages of prior door assemblies.

It is another object of the invention to provide a door assembly which includes means for enclosing accessories.

It is another object of the invention to provide a door assembly that includes side panels which may contain accessories.

It is yet another object of the invention to provide a door assembly with side panels which side panels may be easily removed and replaced or substituted without dismantling other parts of the door assembly.

It is still another object of the invention to provide a door assembly with side panels with space behind the front and rear panels for accessories.

It is still another object of the invention to provide removable panels which do not violate the the manufactures and U.L label warrenties.

Yet another object is to provide a frame for a mail slot with removable and interchangeable plates for a door bell and suite number.

SUMMARY OF THE INVENTION

In accordance with the invention a door assembly is framed by first and second door jambs. Included is a third door jamb spaced at the side of the second door jamb. The second and third door jambs include means for mounting at least one but preferably a plurality of panels to form a front wall of a side panel assembly. One or more of the panels is releasably secured to the door assembly for ease of removal and replacement. There is also a rear wall mounted to said second and third jambs directly behind the front wall. The rear wall includes a releasably secured panel to gain access into a space separating the from and rear wall to install accessories or to unlatch a front wall panel.

There is also included a mail slot which includes a frame with removable and interchangeable plates for accommodating a door bell and a suite number in one or more lateral extensions.

BRIEF DESCRIPTION OF THE FIGURES

The above objects and other objects and advantages of the the present invention will appear more clearly form the following specification in connection with the accompanying drawing, in which.

DESCRIPTION OF THE STRUCTURE AND OPERATION

Figure 1:
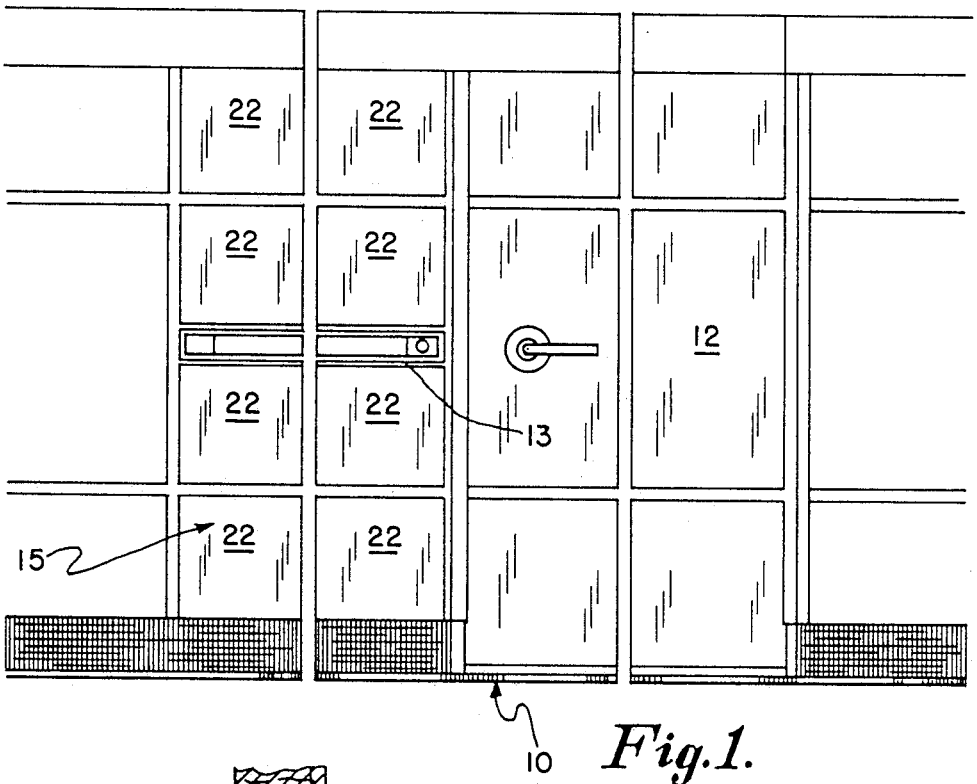
FIG. 1 is a plan view of the door assembly encompassing the invention.
Figure 3:
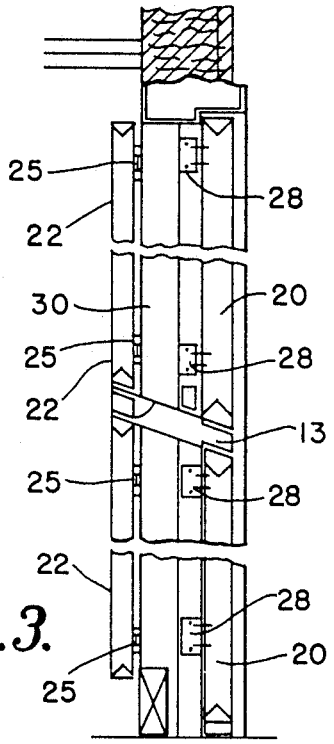
FIG. 3 is a section taken along line 3—3 of FIG. 1.

There is depicted in FIG. 1 a front view of a door assembly 10 including a door 12 and to the left of the door 12 a number of removable panels 22 forming the front wall 19 of a side panel assembly 15. The side panel assembly 15 also includes a rear wall 23 formed from one or more rear panels 20. The rear wall 23 is spaced from and positioned behind the front wall 19. There is a space 30 between the two walls 19 and 23. A mail slot 13 Is defined through the front wall, through the space 30 and though the rear wall 23.

Figure 2:
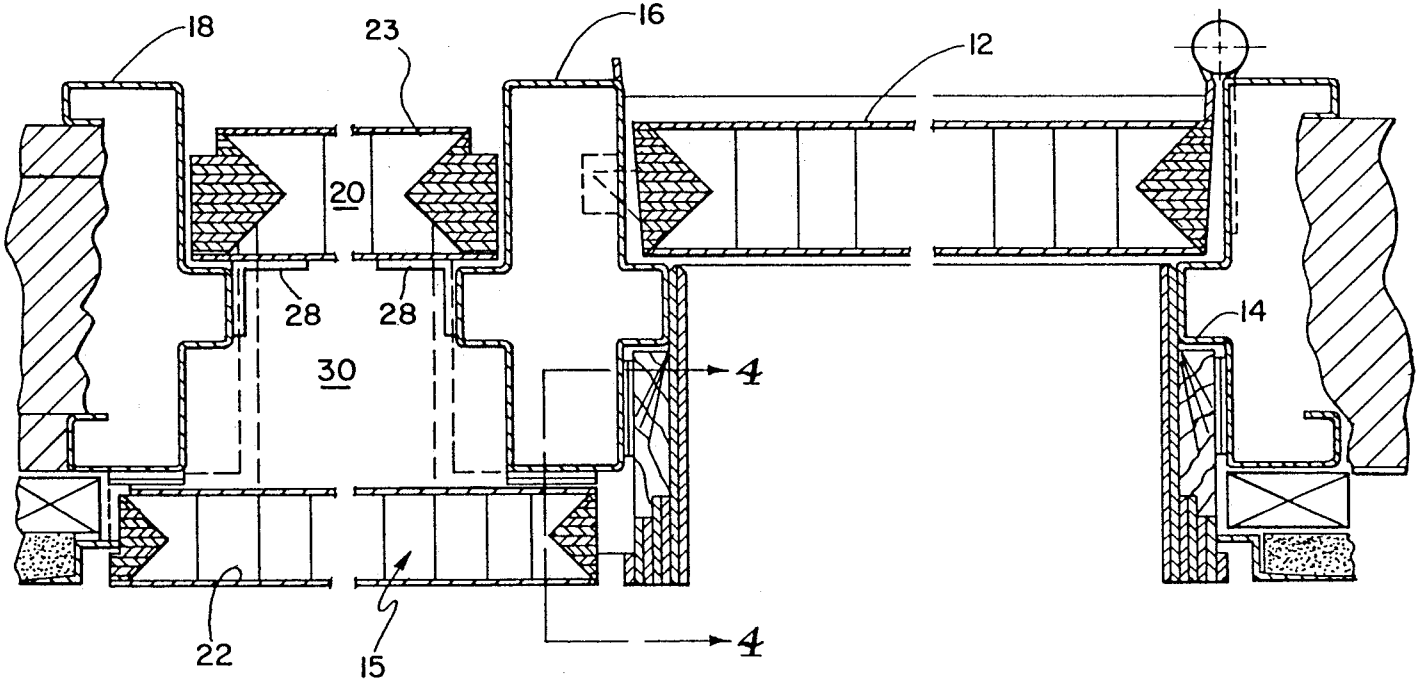
FIG. 2 is a section taken along line 2—2 of FIG. 1.

The door 12 is supported by first and second door jambs 14 and 16 respectively. See FIG. 2. A third door jamb 18 is spaced from door jamb 16.

In most cases the door 12 is fire rated. That is to say it is made to hold back a fire for a period of time such as 1 hour or 1.5 hours. There is also provided a fire rated wall panel 20 mounted to door jambs 16 and 18 by brackets 28 to carry the fire protection into the side panel assembly 15.

Figure 4:
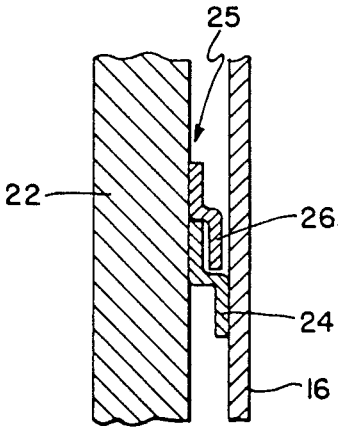
FIG. 4 is detail of the means for mounting panels to the door assembly taken along line 4—4 in FIG. 2.
Figure 8:
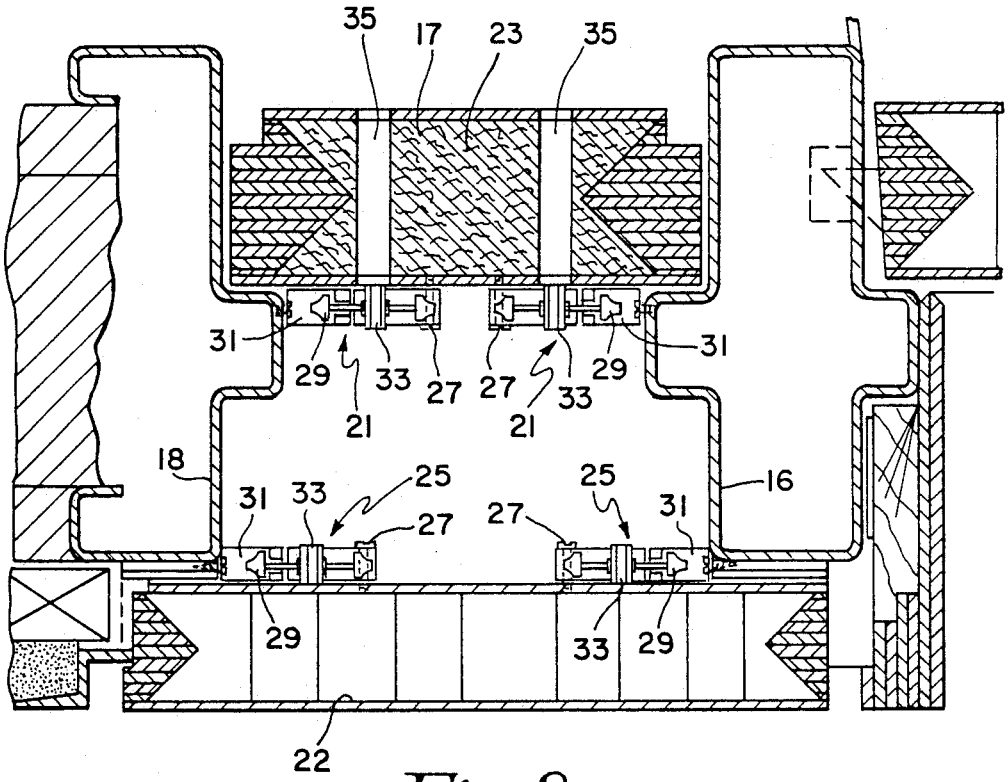
FIG. 8 is a section of front and rear walls showing how access is gained to the space between the walls through the rear wall.

The front "wall" of the side panel assembly 15 is made up of a plurality of so called graphic panels 22. These graphic or wall panels are mounted on the door jambs 16 and 18 in a coplanar arrangement by means of a bracket assembly 25 made up of "Z" shaped cleats 24 and 26. See in particular FIG. 4. The wall panels 22 may be removed and replaced or substituted by simply lifting a wall panel 22 up so that the cleat 26 clears the cleat 24. The wall panels 22 in this instance are held in place by gravity.

Where it is desired to secure the front panels 22 so that they may only be released from the rear through the space 30, a releasably secured panel is formed in the rear wall 23. One such alternative construction in the side panel assembly is shown in FIG. 8.

A removable rear panel 17 is secured to the second and third jambs 16 and 18 by means of fastening means 21. The front panel 22 depicted in FIG. 8 is also secured to these jambs by similar fastening means 25.

Fastening means 21 and 25 comprise cam actuated devices sold under the name ROTO Locks. One section 31 is secured to the appropriate jamb. A second section 27 is secured to the appropriate removable panel 17 or 22. The second section 27 of the lock contains a hook like cam member 29 which can be rotated into engagement with the first section to fasten the panel to the jamb.

The Roto Lock is actuated by means of a hexagonal central aperture 33. In the illustration a hole 35 is provided through the removable rear panel 17 to permit the access to the central hexagonal aperture 33.

When the cam member 29 is rotated into engagement with the section 31 the panel is secured to its respective wall. When the cam member is rotated out of engagement with the first section 31 the panel may be removed from its respective wall.

Any other fastening means such as screws may be used in the place of the cam locks.

With the removable rear panel 17 in FIG. 8 removed from the rear wall access may be gained to the fastening means 25 front panel 22 in FIG. 8. The front panel 22 may be fastened or released from the jambs 16 and 18 and thereby fastened or removed from the front wall 19 by rotating the hook 29 of the fastening means 25 into or out of engagement with the first section 31.

The wall or graphic panels 22 can serve several functions. They can carry the name of the tenant occupying the space behind the door. Where a tenants name changes the obsolete panel is removed and another substituted. The veneer of the door as well as the veneer of the graphics panels 22 are man made and can be accurately matched.

Another feature of the invention is the space 30 in the side panel assembly 15. There is sufficient space to carry electrical wires for door releases, door bells, or electronic keys. There is also sufficient space to mount within the space 30, a surveillance camera such as the 68*c* video door vision camera.

Where a camera is used one of the opposing graphic panels 22 will contain a complementary door plate permitting one to see through the front wall panel.

The wall panels 22 and the fire rated panel 20 in the illustrations are configured to contain a mail slot 13 which is secured to the door jams 16 and 18.

Figure 5:
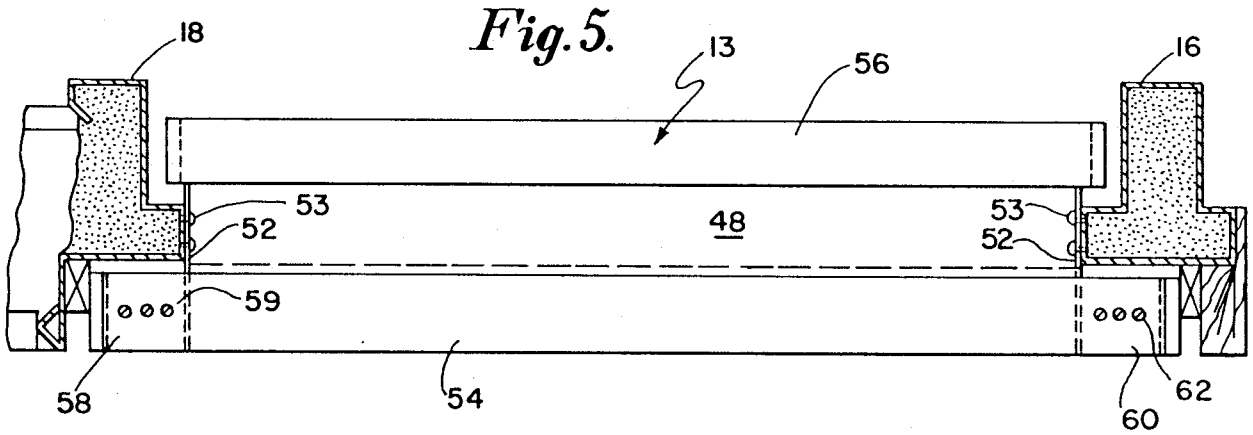
FIG. 5 is a top view of a mail slot embodying the principles of the invention.

Referring to FIG. 5 of the drawings there is top detail view of the mail slot 13. The mail slot 13 contains a center tubular body 48 defined by top, bottom, and side walls which traverses the thickness of the front wall 19, the space 30 and the rear wall 23. The tubular body 48 is situated between an interior frame 56 and and exterior frame 54. The walls of the center tubular body 48 define a front opening 55 and a rear opening 57 through which mail etc. passes. The interior frame 56 encircles and frames the rear opening 57.

The exterior frame 54 contains identical left and right lateral extensions 58 and 60 which extend to the side of the front opening 55. The lateral extensions are configured to contain either a suite number module 64 or a door bell module 66. See FIG. 6.

Figure 6:
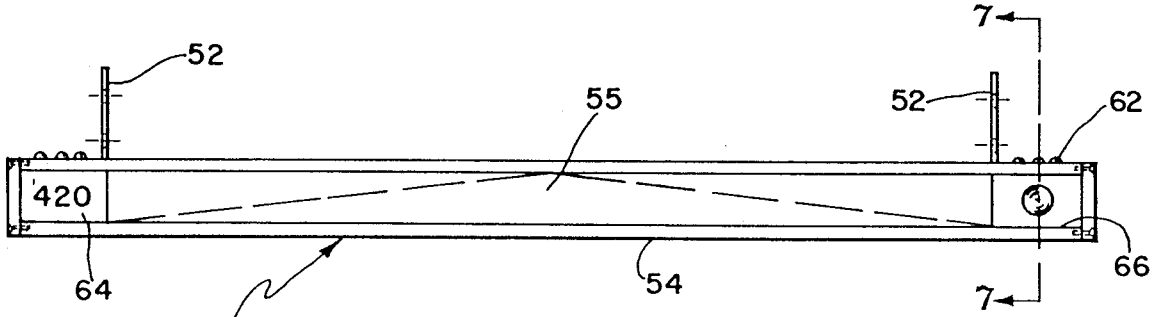
FIG. 6 is a front view of the mail slot
Figure 7:
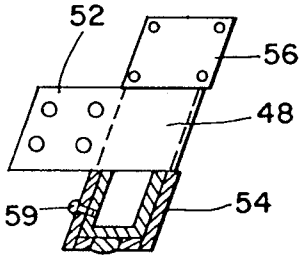
FIG. 7 is a section of the mail slot taken along lines 7—7.

Important features of the mail slot 13 are the removable and interchangeable modules 64 and 66 shown in FIG. 6. These are inserted in the extensions 58 and 60 and secured to the front frame 54 by means of screws 59 and 62 inserted in the extensions. See FIG. 7.

Holes for screws 59 and 62 are formed in the extensions 58 and 60 respectively. Shown in the Figures are two lateral extensions. Clearly a Single lateral extension may be used as well.

The mail slot 13 is secured to the door assembly by screwing a mounting bracket 52 affixed to the body 48 to the second and third door jamb as shown in FIG. 5.

The suite number plate 64 and the door bell plate 66 are placed into position by removing the graphic plates 22 above the mail slot 13 (See FIG. 1)

The important features of the inventions are a door assembly containing removable graphic panels that make up a front side panel assembly. A space is provided behind the front side panel assembly for accessories. There is also included a mail slot which contains removable and interchangeable suite number and door bell plates.

The front graphic panel may be releasably secured so that they may be replaced directly by lifting the graphic panel off the front wall. Alternatively the means for securing a graphic panel to the front wall can be accessed only through the rear wall to provide a more secure system. All of these features are coordinated into an attractive door assembly.

The second door jamb can be made removable to facilitate the movement of large objects through the door.

The door assembly is designed to project the stature of a double door thus providing a prominent profile to all building renters.

The technical and cost advantages are in the doors reusable kit of parts. The fire rated door is to expensive to throw-away whenever a tenant vacated the property. On the other hand, the removable panel has less cost involved in its production. The use of man-made wood allows a thicker veneer which makes matching and refinishing easier.

The maintenance factors available with the reusable qualities of the door assembly. There is also the ease of adding accessories or appliances such as video cameras and electronic keys. The layer quality of the jamb and other components have been cited as giving the impression that there is more door than actually exits. This is thought to have been a deterrent in several cases.

While there has been shown and described what is at present considered to be the preferred embodiment of the invention, it will be obvious to those skilled in the art that various changes and modifications may be made therein without departing from the true scope of the invention as defined in the appended claims.

What is claimed:

1. A door assembly comprising;

first second and third spaced apart vertical door jambs;

a door hung between the first and second door jambs;

first mounting means on said second and third door jambs;

a front wall comprising at least one front wall panel having second mounting means complementary to said first mounting means for releasably securing said front wall panel to said second and third door jambs whereby said front wall panel may be removed and replaced without dismantling other parts of the front wall;

a rear wall situated behind but spaced from the front wall having an access hole for permitting access into the space between the front and rear walls; and closure means for said access hole for opening and closing said access hole.

2. A door assembly as defined in claim 1 where the closure is a hinged closure.

3. A door assembly as defined in claim 1 where the closure is releasably secured rear wall panel and secured to said second and third door jambs.

4. A door assembly as defined in claim 1 where the closure is a releasably secured rear wall panel.

5. A door assembly comprising:

first, second and third spaced apart vertical door jambs;

a door hung between the first and second jambs;

a front wall situated to the side of the door comprising at least one releasably secured front wall panel; and a rear wall spaced from and situated behind the front wall having an access hole for providing access to the space between the front and rear wall; and closure means for opening and closing said access hole.

6. A door assembly as defined in claim 5 where the closure means is a hinged closure.

7. A door assembly as defined claim 5 where the closure is a releasably secured panel.

8. A door assembly as defined in claim 5 where the front and rear walls are hung on a pair of spaced door jambs and said front wall panel and closure are releasably secured to said door jambs.

9. A door assembly comprising:

a door hung between a pair of door jambs;

a side panel assembly secured to one of said pair of door jambs comprising a front wall and a rear wall, said rear wall being placed behind the front wall and spaced from the front wall;

a front wall panel releasably secured to the front wall by complementary mounting means accessed through the space between the front and rear wall whereby said front wall panel may be removed and replaced without dismantling other parts of the front wall;

an access hole defined in the rear wall for permitting access into the space between the front wall and the rear wall; and closure means for the access hole for opening and closing the access hole.

* * * * *